US007240401B2

(12) United States Patent
Tamehira et al.

(10) Patent No.: US 7,240,401 B2
(45) Date of Patent: Jul. 10, 2007

(54) HINGE MECHANISM FOR PLATEN COVER

(75) Inventors: Masato Tamehira, Nara (JP); Yoshiyuki Nishizato, Nara (JP); Yasumasa Morimoto, Kashihara (JP); Yoshitaka Matsumoto, Shijonawate (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 282 days.

(21) Appl. No.: 10/654,490

(22) Filed: Sep. 4, 2003

(65) Prior Publication Data

US 2004/0045129 A1 Mar. 11, 2004

(30) Foreign Application Priority Data

Sep. 6, 2002 (JP) ..... P2002-261902

(51) Int. Cl.
*E05D 11/00* (2006.01)
*E05F 1/08* (2006.01)

(52) U.S. Cl. ..... 16/284; 16/277; 355/75; 399/379

(58) Field of Classification Search ..... 16/277, 16/335, 284, 285, 322, 325, 255, 352, 308, 16/359, 280–282, 361, 366, 371, DIG. 34, 16/286, 298; 379/433.13, 433.12, 433.11; 355/75; 399/377, 380, 379; 455/550, 556
See application file for complete search history.

(56) References Cited

U.S. PATENT DOCUMENTS 3,103,693 A * 9/1963 Tenniswood et al. ..... 16/289
3,496,595 A * 2/1970 Larson ..... 16/289
3,906,587 A * 9/1975 Little ..... 16/289
4,365,893 A * 12/1982 Kimura et al. ..... 355/75
5,541,712 A * 7/1996 Fujitaka et al. ..... 399/380
5,621,501 A * 4/1997 Matsuo et al. ..... 355/75
6,100,963 A * 8/2000 Hosaka ..... 355/75
6,158,085 A 12/2000 Oshiro
6,327,457 B1 * 12/2001 Hashimoto ..... 399/379
6,415,477 B1 * 7/2002 Hosaka et al. ..... 16/327
6,530,122 B1 * 3/2003 Kondou et al. ..... 16/335
6,629,336 B2 * 10/2003 Hosaka et al. ..... 16/327
6,684,456 B2 * 2/2004 Lee ..... 16/342

(Continued)

FOREIGN PATENT DOCUMENTS

CN 1199879 A 11/1998

(Continued)

*Primary Examiner*—Robert J. Sandy
*Assistant Examiner*—Andre' L. Jackson
(74) *Attorney, Agent, or Firm*—Birch, Stewart, Kolasch & Birch, LLP

(57) ABSTRACT

A hinge mechanism of an image forming apparatus supporting a platen cover for holding an original at a fixed position on a platen glass includes a hinge unit for supporting the platen cover in such a manner that the platen cover can be opened and closed by swinging it up and down, a compression coil spring for biasing the platen cover in its opening direction, and a hinge holder attached to a housing of the apparatus for accommodating the compression coil spring. The hinge unit is provided with a hinge torque keeping mechanism which causes the compression coil spring to produce a specific amount of hinge torque to bias the platen cover in its opening direction even when the platen cover is closed.

5 Claims, 7 Drawing Sheets

U.S. PATENT DOCUMENTS 6,928,698 B2 * 8/2005 Chen et al. ..... 16/277

FOREIGN PATENT DOCUMENTS

JP 60-055334 A 3/1985
JP 4-166581 A 6/1992
JP 2001-057611 2/2001
JP 2002-023431 1/2002

* cited by examiner

FIG.
2

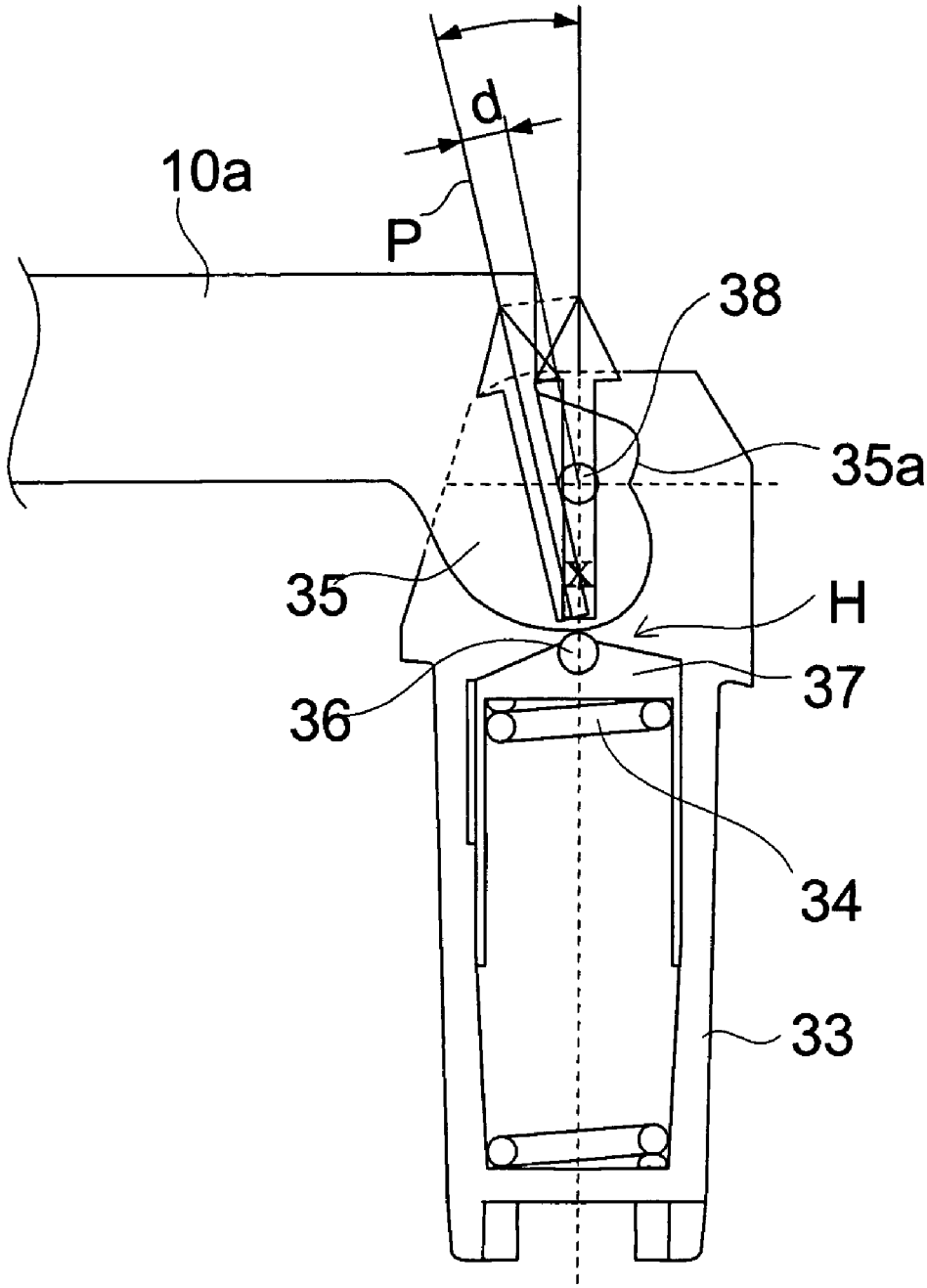
FIG.
4

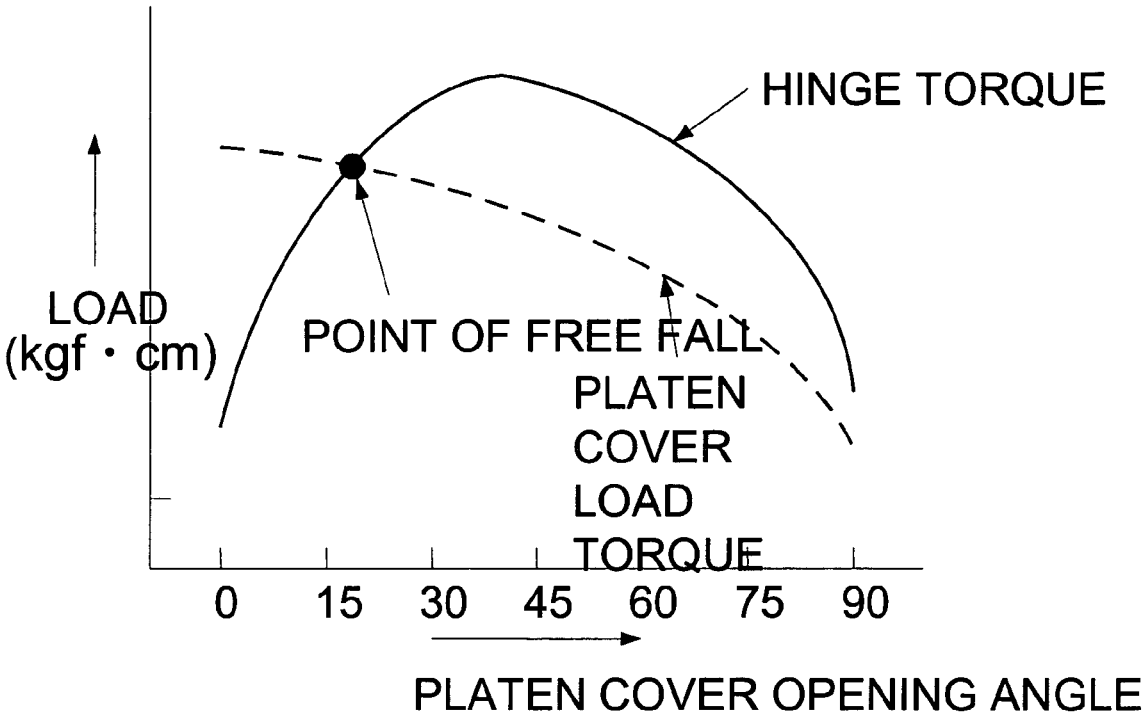
FIG.
5

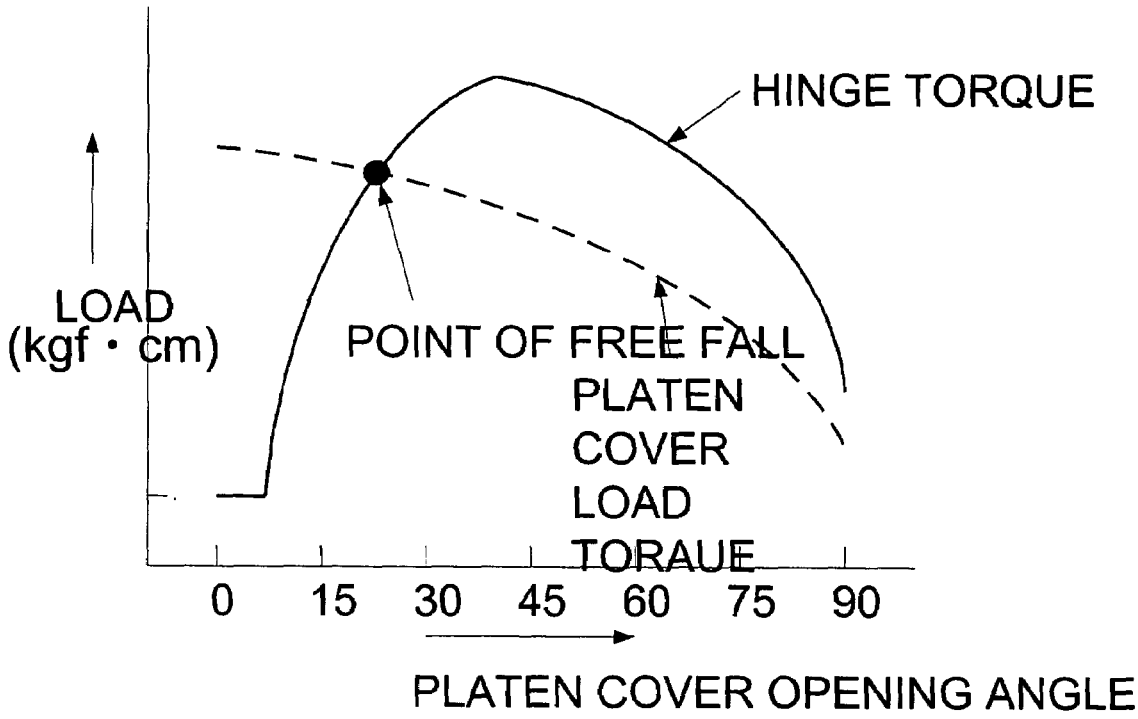
PRIOR
ART
FIG.
6

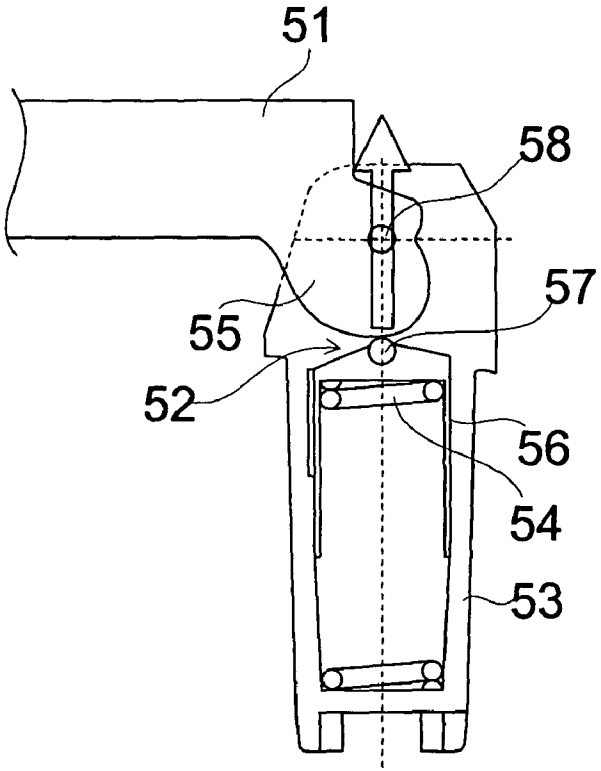
PRIOR ART FIG. 7B
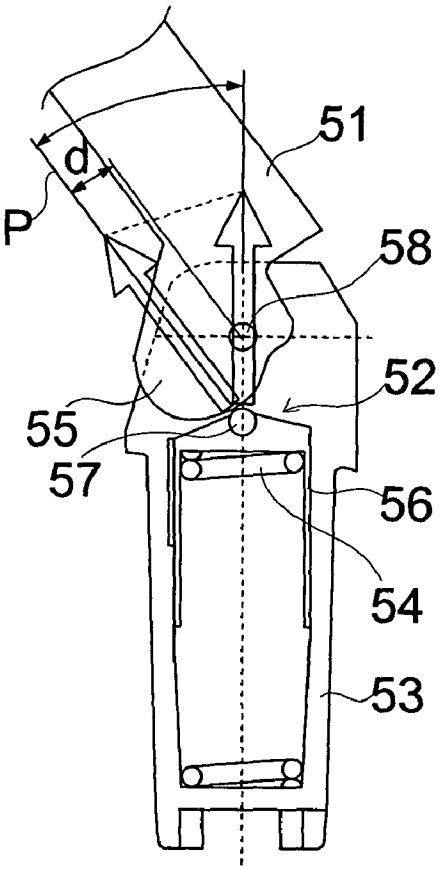
PRIOR ART FIG. 7A

HINGE MECHANISM FOR PLATEN COVER

This Nonprovisional application claims priority under 35 U.S.C. § 119(a) on Patent Application No. 2002-261902 filed in Japan on Sep. 6, 2002, the entire contents of which are hereby incorporated by reference.

BACKGROUND OF THE INVENTION

1. Field of the Invention

The present invention relates to a hinge mechanism for a platen cover of an image forming apparatus for holding an original document placed on a platen glass at a fixed position, wherein the platen cover is installed in a manner that allows an operator to open and close the platen cover when placing and removing the original document.

2. Description of the Related Art

A document reading section of an image forming apparatus, such as various types of copying machines and printers, is provided with a platen cover, which can be lowered onto and lifted up from a platen glass, for holding an original document placed on the platen glass at a fixed position and for keeping out stray light from an optical scanning system. Normally, this kind of platen cover is swingably supported with its pivot end fixed to a housing of the apparatus by means of hinges. Each hinge is usually associated with an elastic member for biasing the platen cover in its opening direction to ensure smooth opening and closing action of the platen cover.

A hinge mechanism employing a torsional compression coil spring as an elastic member is disclosed in Japanese Laid-open Patent Publication No. 2002-23431, for example. Also, a hinge mechanism employing a compression coil spring as an elastic member is disclosed in Japanese Laid-open Patent Publication No. 2001-57611, for example. As shown in FIGS. 7A and 7B, for instance, a hinge unit 52 supporting a platen cover 51 is normally inserted into and held in a cylindrical hinge holder 53 provided at one end of a housing of an image forming apparatus together with a compression coil spring 54 in such a manner that the platen cover 51 can be opened and closed by swinging it up and down about a pivot axis of the hinge unit 52.

In a case where the hinge unit 52 is accommodated in the hinge holder 53 as stated above, however, the compression coil spring 54 would occasionally produce violent vibrations inside the hinge holder 53 when the platen cover 51 is opened or closed. If such vibrations occur from time to time, the hinge holder 53, usually made of a rigid resin material, is apt to break after an extended period of use. This would result in such a problem that the platen cover 51 lies loose on the platen cover, causing displacement of an original, or stray light enters an optical scanning system. This kind of problem is assumed to occur for reasons explained below.

The conventional image forming apparatus is designed such that a hinge torque exerted by the compression coil spring 54 of the hinge unit 52 biasing the platen cover 51 in its opening direction remains at zero, or no load conditions, near the closed position of the platen cover 51 at and below a point of free fall (within a range of 0° to a few degrees above 10° in terms of the opening angle of the platen cover 51) as shown in FIG. 6, for example. With this arrangement, the compression coil spring 54 exerts no biasing force (hinge torque) on the platen cover 51 near its closed position, so that the platen cover 51 descends by its own weight down to the closed position with certainty.

This construction serves to prevent the platen cover 51 from being left unclosed. However, if the platen cover 51 is hastily closed for one reason or another, the compression coil spring 54, which suddenly turns from a loaded state to an unloaded state, violently vibrates inside the hinge holder 53 and collides with its internal wall. This would gradually lead to eventual breakage of the hinge holder 53 from inside.

More specifically, when the platen cover 51 is opened to a certain degree, a roller 57 fitted in and supported by a roller retainer 56, which is forced upward by a spring force directed vertically upward, comes into contact with a cam element 55 which is fixed to a pivot end of the platen cover 51 as shown in FIG. 7A, so that the roller 57 biases the cam element 55 upward. This biasing force of the roller 57 produces the aforementioned hinge torque that causes the platen cover 51 to swing in its opening direction, wherein the hinge torque is defined as the product of a vector pointing to the cam center (representing a force acting in the direction of a perpendicular P to a tangent line passing a point of contact between the cam element 55 and the roller 57) multiplied by the distance d from the point of contact to the point of support of the hinge unit 52.

When the platen cover 51 is closed, on the other hand, the perpendicular to the tangent line passing the point of contact between the cam element 55 and the roller 57 which is forced upward by the spring force directed vertically upward passes a pivot center 58 of the cam element 55 (provided above the hinge holder 53) that serves as a point of support of the platen cover 51 as shown in FIG. 7B, so that the hinge torque becomes zero. This means that the hinge torque biasing the platen cover 51 in its opening direction is zero in a state in which the compression coil spring 54 is slightly depressed (compressed).

Therefore, if the platen cover 51 is hastily closed from its open position, the compression coil spring 54 rapidly changes to the compressed state in which the hinge torque is zero. As a consequence, pressure balance becomes unstable and elastic force of the compression coil spring 54 causes itself to vibrate violently in the hinge holder 53 and collide with its internal wall, and this causes gradual breakage of the hinge holder 53, particularly from its lower portion.

Although not illustrated in detail, there is provided a clearance between the internal wall of the hinge holder 53 and the compression coil spring 54 to allow flexible compression and extension of the compression coil spring 54. For this reason, the compression coil spring 54 is likely to oscillate loose within the hinge holder 53, producing violent vibrations when the platen cover 51 is opened or closed.

SUMMARY OF THE INVENTION

This invention has been made to provide a solution to the aforementioned problems of the prior art. Specifically, it is an object of the invention to provide a hinge mechanism for a platen cover featuring high durability such that a hinge holder does not break even when the platen cover is repeatedly opened and closed.

According to the invention, a hinge mechanism of an image forming apparatus supporting a platen cover for holding an original at a fixed position on a platen glass includes a hinge unit for supporting the platen cover in such a manner that the platen cover can be opened and closed by swinging it up and down, an elastic member (compression coil spring) for biasing the platen cover in its opening direction, and a hinge holder attached to a housing of the apparatus for accommodating the elastic member. The hinge unit is provided with a hinge torque keeping mechanism which causes the elastic member to produce a specific amount of hinge torque to bias the platen cover in its opening direction even when the platen cover is closed.

As discussed earlier, the conventional image forming apparatus is normally constructed such that the platen cover is supported swingably about one end of the housing of the apparatus by means of hinges, each of which is provided with an elastic member for biasing the platen cover in its opening direction to ensure smooth opening and closing action of the platen cover. In the conventional hinge mechanism, a torsional compression coil spring or a compression coil spring is used as the elastic member. The spring (elastic member) is usually fitted and held in a cylindrical hinge holder at the rear end of the apparatus housing.

Although it is possible to prevent the platen cover from being left unclosed in the conventional arrangement, the compression coil spring would produce violent vibrations inside the hinge holder when the platen cover is hastily closed, for example. In such a case, the compression coil spring would collide with the internal wall of the hinge holder, and this gradually leads to eventual breakage of the hinge holder from inside.

According to the aforementioned construction of the invention, however, the hinge unit continues to produce a small amount of hinge torque biasing the platen cover in its opening direction even when the platen cover is closed, so that the elastic member is kept in a stable state in the hinge holder. Therefore, unlike the conventional hinge mechanism, the hinge mechanism of the invention does not cause such a problem as breakage of the hinge holder due to violent vibrations of the elastic member which used to occur when closing the platen cover of the conventional apparatus. This serves to improve the durability of the hinge mechanism.

Preferably, the hinge torque keeping mechanism includes a cam for ensuring smooth opening and closing action of the platen cover and a roller which rolls over the cam provided between the platen cover and the hinge unit.

In this construction, the hinge torque produced by the elastic member is smoothly transmitted to the platen cover via the roller and the cam when the platen cover is opened and closed, making it possible to ensure smooth opening and closing action of the platen cover.

The cam may be so shaped as to hold the platen cover stationary at a particular open position.

In this case, the platen cover can be stopped at a specific opening angle, so that it is made possible to properly set the original in position on the platen glass and verify the position of the original with ease and certainty, thereby providing improved operability.

Also, the cam may be shaped such that a generally upward directed perpendicular to a tangent line passing a point of contact between the cam and the roller is offset from a pivot axis of the cam when the platen cover is closed.

In this construction, the generally upward directed perpendicular to the tangent line passing the point of contact between the roller and the cam does not pass the pivot axis of the cam when the platen cover is closed, so that a small amount of hinge torque directed generally upward is exerted on the platen cover even when it is closed. This serves to maintain the elastic member in a stable state in the hinge holder.

Still preferably, the generally upward directed perpendicular to the tangent line passing the point of contact between the cam and the roller is offset from the pivot axis of the cam toward the front of the platen cover.

In this construction, the generally upward directed perpendicular to the tangent line passing the point of contact between the roller and the cam is offset from the pivot axis of the cam toward the front of the platen cover when the platen cover is closed, so that the hinge torque is exerted on the closed platen cover. This serves to keep the elastic member in a stable compressed state within the hinge holder.

These and other objects, features and advantages of the invention will become more apparent upon reading the following detailed description along with the accompanying drawings.

BRIEF DESCRIPTION OF THE DRAWINGS

FIG. 4 is a diagram showing the construction of hinge units used in the copying machine;

FIG. 5 is a graph showing how hinge torque and platen cover load torque vary;

FIG. 6 is a graph showing how hinge torque and platen cover load torque vary in one example of a conventional hinge mechanism; and FIGS. 7A and 7B are diagrams showing a typical construction of the conventional hinge mechanism (platen cover opening angle: 45° in FIG. 7A, 0° in FIG. 7B).

DETAILED DESCRIPTION OF THE PREFERRED EMBODIMENTS OF THE INVENTION

A hinge mechanism for a platen cover according to an embodiment of the invention is now described with reference to the accompanying drawings.

Image Forming Apparatus

Figure 1:
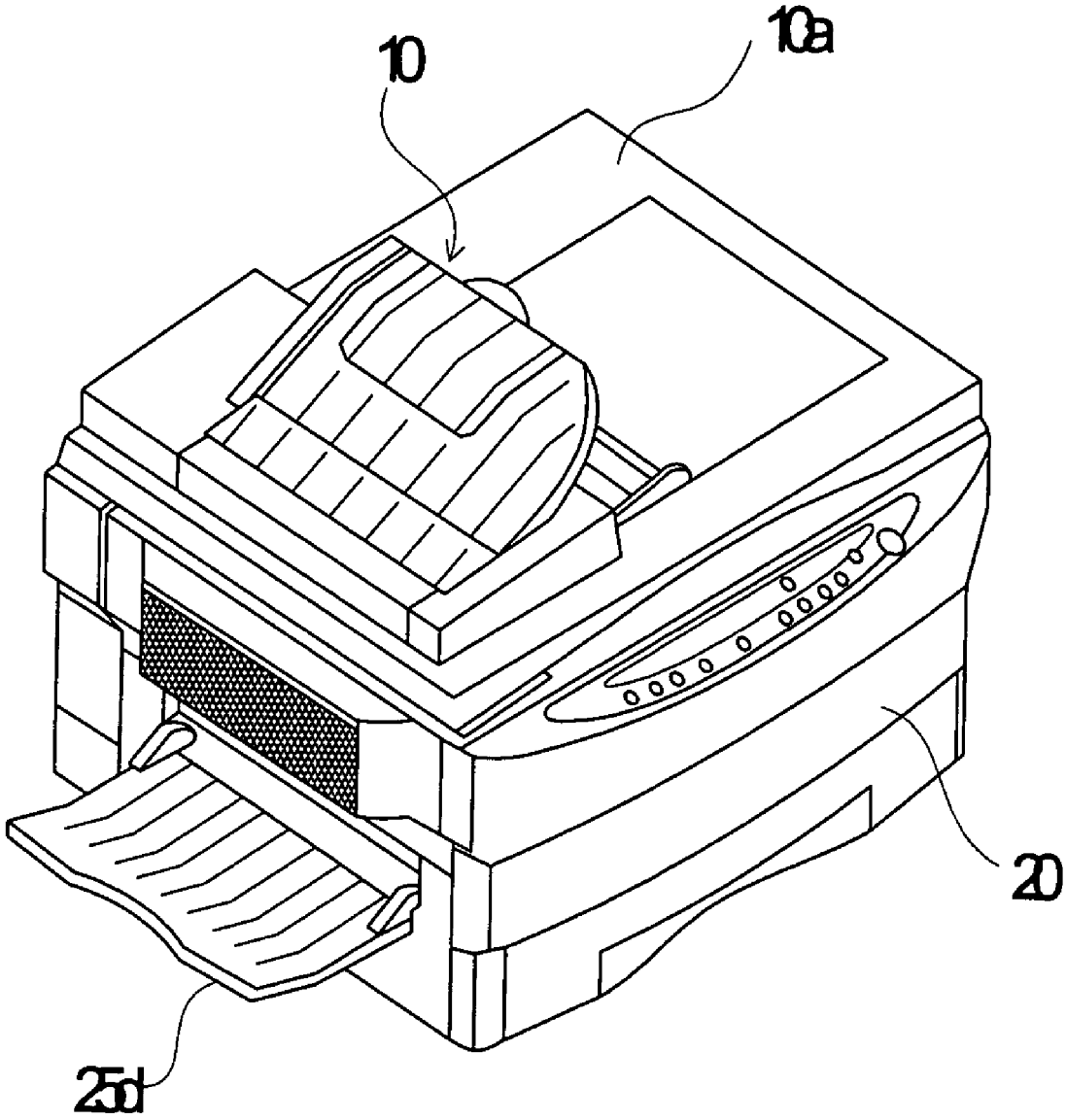
FIG. 1 is a perspective view of a copying machine according to an embodiment of the invention.
Figure 2:
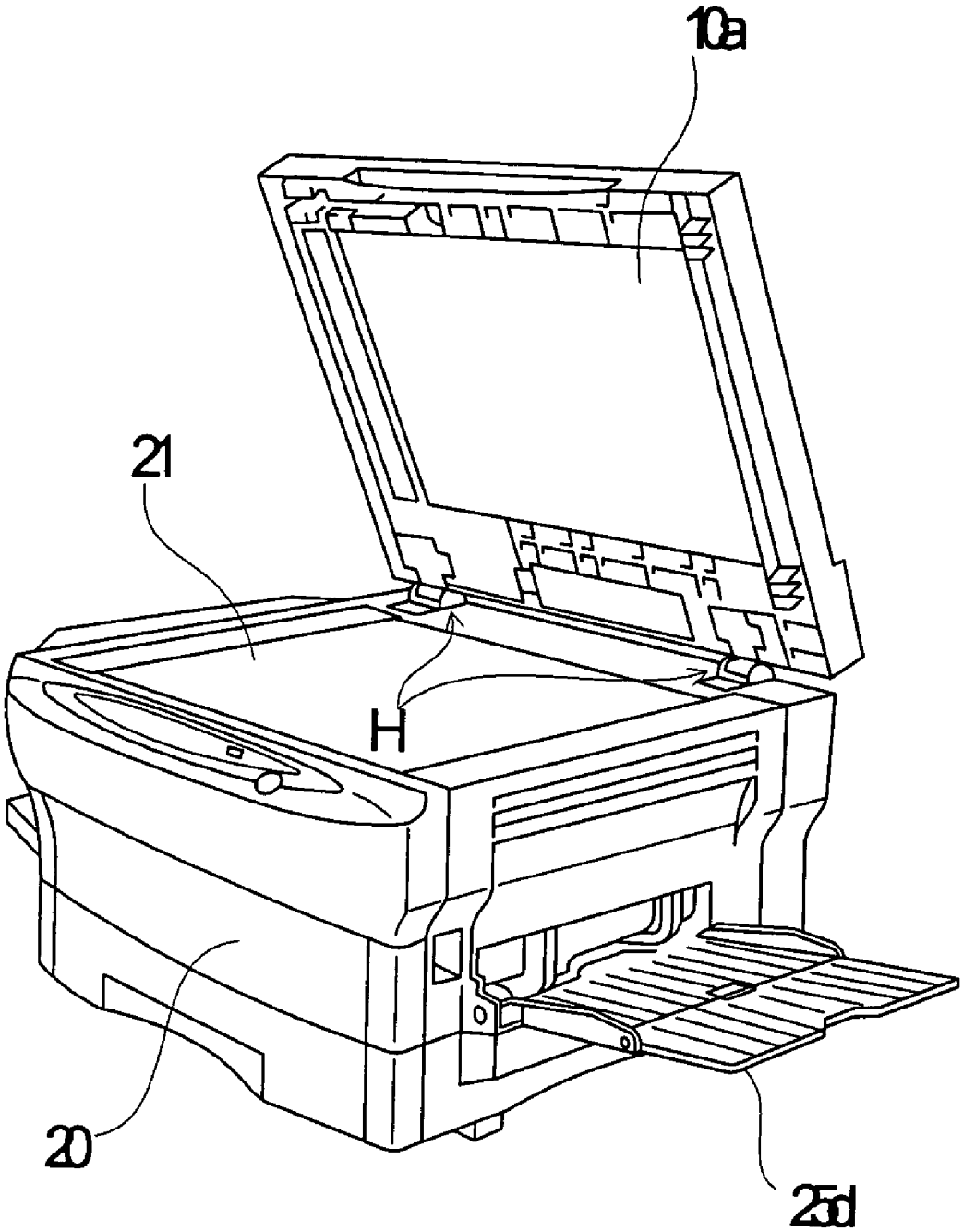
FIG. 2 is a perspective view of the copying machine as its platen cover is opened.

FIG. 1 is a perspective view of a copying machine, a typical example of an image forming apparatus, according to an embodiment of the invention. The copying machine includes a housing 20 and an automatic document feeder 10 which is attached to the housing 20 in a manner that the automatic document feeder 10 can be swung up and down to uncover and cover the top of the housing 20. FIG. 2 is a perspective view of the copying machine in which the automatic document feeder 10 is lifted to uncover the top of the housing 20. At the top of the housing 20 there is provided a platen glass 21 on which an original document 61 is placed. It is possible to place the original 61 on top of the platen glass 21 after swinging up the automatic document feeder 10 as shown in FIG. 2. In this embodiment, the automatic document feeder 10 is mounted on a platen cover 10*a* immediately on its top side in such a manner that they together constitute a single structure.

Figure 3:
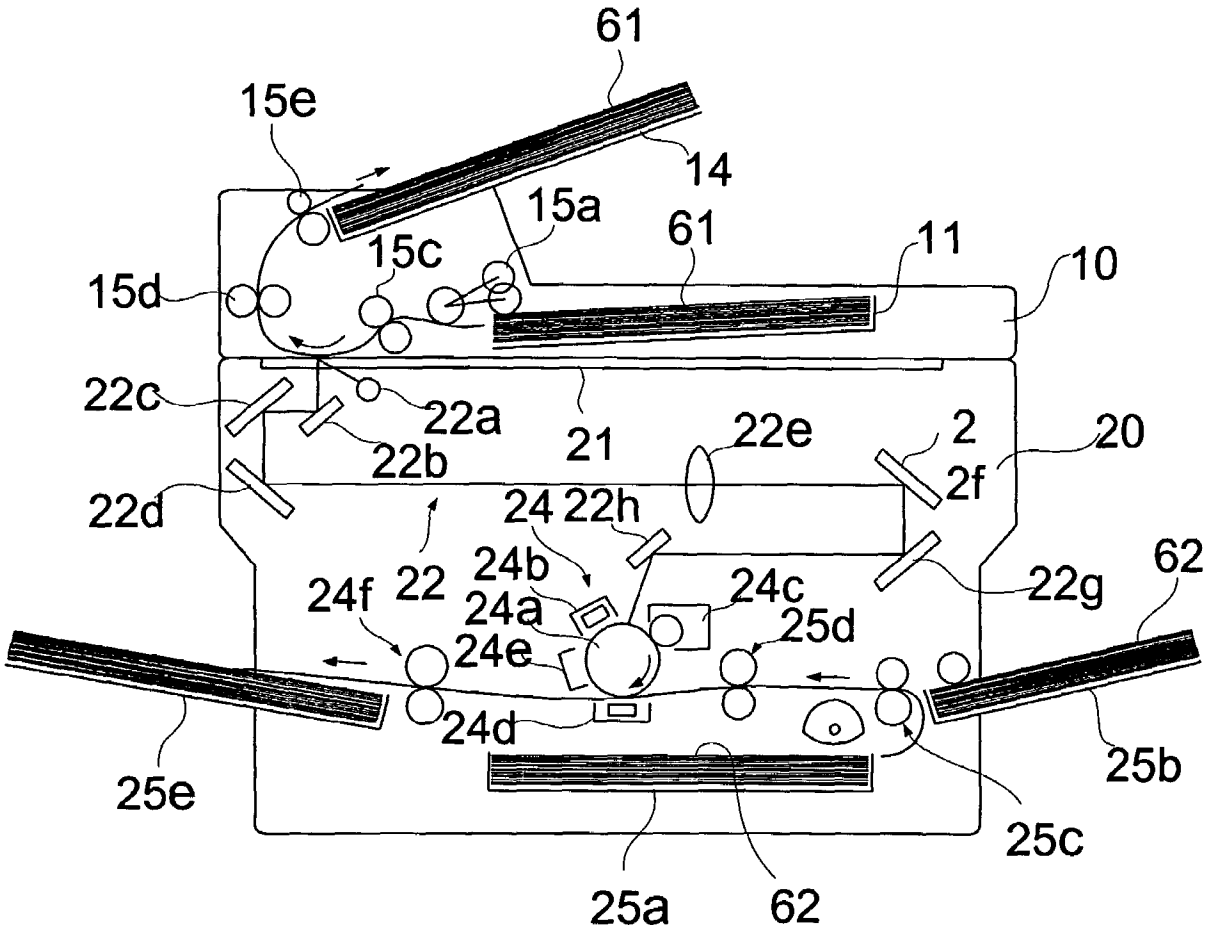
FIG. 3 is a sectional diagram showing the construction of the copying machine.

FIG. 3 is a sectional diagram showing the construction of the copying machine. In an upper part of the housing 20, there is provided an optical scanning system 22 which projects light onto the original 61 placed on the platen glass 21 to optically scan, or read, its image. The optical scanning system 22 includes a lamp 22*a* and a first reflection mirror 22*b*. The lamp 22*a* projects light toward a document reading section located at one side of the platen glass 21 (left side as illustrated in FIG. 3).

The light projected from the lamp 22*a* is reflected by the original 61, and the first reflection mirror 22*b* reflects this reflected light to one side (left side) of the housing 20 in a horizontal direction. There is made an arrangement to enable the lamp 22*a* and the first reflection mirror 22*b* to together move horizontally in a direction opposite to the direction in which the first reflection mirror 22*b* reflects the light all across the platen glass 21 on its bottom side. With this arrangement, it is possible to expose the entire surface of the original 61 placed on the platen glass 21.

The light reflected by the first reflection mirror 22*b* is further reflected by a second reflection mirror 22*c* and a third reflection mirror 22*d*, which are provided on one side as a pair at upper and lower positions, respectively, to reverse the direction of the light whereby the light is directed toward a lens 22*e* provided approximately at the middle of the housing 20 in the left/right direction as shown in FIG. 3. When the lamp 22*a* and the first reflection mirror 22*b* move in the horizontal direction at a specific speed to scan the original image, the second reflection mirror 22*c* and the third reflection mirror 22*d* together move in synchronism, but at half the speed of the lamp 22*a* and the first reflection mirror 22*b*, in the same scanning direction (left to right as illustrated in FIG. 3). Therefore, the light reflected from the original 61 placed on the platen glass 21 always travels the same length of light path during scanning operation.

The light reflected by the third reflection mirror 22*d* passes through the lens 22*e* and is reflected by a fourth reflection mirror 22*f* and a fifth reflection mirror 22*g*, which are provided at fixed positions on the side of the housing 20 opposite the side where the second reflection mirror 22*c* and the third reflection mirror 22*d* are provided, to reverse the direction of the light again. The light reflected by the fifth reflection mirror 22*g* hits a sixth reflection mirror 22*h*, which reflects the light toward a photosensitive drum 24*a* of an electrophotographic process unit 24 provided beneath the sixth reflection mirror 22*h*.

The photosensitive drum 24*a* has on its cylindrical surface a photosensitive coating which is charged by a charger 24*b*. The light projected from the optical scanning system 22 in the aforementioned manner hits the surface of the photosensitive drum 24*a*, thereby exposing its photosensitive coating. Consequently, there is formed an electrostatic latent image corresponding to the original image on the photosensitive coating. The electrostatic latent image formed in charged areas of the photosensitive coating is developed as it attracts toner particles 24*c* forming a toner image.

Printing paper 62 stored in a paper cassette 25*a* or in a manual feed tray 25*b* is fed by two pairs of rollers 25*c*, 25*d* into the electrophotographic process unit 24. The toner image formed on the photosensitive drum 24*a* is transferred onto a sheet of printing paper 62 by a toner transfer unit 24*d*.

A cleaning unit 24*e* removes residual toner particles from the surface of the photosensitive drum 24*a*. The toner image transferred onto the sheet 62 is fused thereon by a fuser unit 24*f* and the sheet 62 carrying the fixed toner image is ejected onto a discharge tray 25*e*.

The automatic document feeder 10 is so constructed as to cover the entire top surface of the platen glass 21 and the housing 20. There is provided a document feed tray 11 from which each sheet of the original document 61 is fed to an image reading area of the platen glass 21 located at one side (left side as illustrated in FIG. 3). With the automatic document feeder 10 placed down on the platen glass 21 to cover the top of the platen glass 21, one or more sheets of the original document 61 can be loaded on the document feed tray 11. The originals 61 are fed one after another, from top to bottom, to the image reading area of the platen glass 21.

The automatic document feeder 10 is provided with a vertically movable pickup roller 15*a* located near an output end of the document feed tray 11. A pair of document feed rollers 15*c* are provided downstream of the pickup roller 15*a* in the document feed direction. The document feed rollers 15*c* transfer the original 61 in such a manner that it passes across the image reading area of the platen glass 21.

When passing across the image reading area of the platen glass 21, the original 61 is pressed against the image reading area. The lamp 22*a* of the optical scanning system 22 projects light on the original 61 as it passes over the image reading area and the optical scanning system 22 guides the light reflected by the original 61 toward the photosensitive drum 24*a* as discussed above. The optical scanning system 22 reads, or scans, the image of the original 61 passing across the image reading area of the platen glass 21 line by line and projects light corresponding to the original image onto the photosensitive drum 24*a* in the aforementioned manner.

There is provided a document output tray 14 at an oblique angle above the document feed tray 11. The original 61 which has passes over the image reading area of the platen glass 21 is guided upward. The original 61 is transferred further upward by a pair of transfer rollers 15*d* and ejected onto the document output tray 14 by a pair of document output rollers 15*e*.

Platen Cover Hinge Mechanism

In the copying machine thus constructed, a pivot end of the platen cover 10*a* which is assembled with the automatic document feeder 10 to form a single structure is fixed to the top of the housing 20 close to its rear end by means of a pair of hinge units H in such a manner that the platen cover 10*a* can be swung up and down about its hinged end. Each of these hinge units H is constructed as shown in FIG. 4. Specifically, a roller 36 is fitted in and supported by a roller retainer 37 which is fitted on a compression coil spring (elastic member) 34 as illustrated. The compression coil spring 34 is fitted in a hinge holder 33, which is made of a rigid resin material, together with the roller retainer 37. The hinge holder 33 is fitted in a hole formed in a rear end portion of the housing 20.

The rollers 36 of the two hinge units H are held in rolling contact with respective cams 35 which are fixed to the platen cover 10*a* at its pivot end. Rotary shafts (pivot axes) 38 of the cams 35 are provided above the individual hinge holders 33 and the platen cover 10*a* swings up and down about the rotary shafts 38 of the cams 35. The hinge mechanism is constructed such that the compression coil spring 34 of each hinge unit H biasing the platen cover 10*a* in its opening direction exerts a certain amount of hinge torque even when the platen cover 10*a* is closed as shown in FIG. 4. To achieve this, each hinge unit H is provided with a hinge torque keeping mechanism for maintaining the hinge torque produced by the compression coil spring 34 that biases the platen cover 10*a* in the opening direction even when the platen cover 10*a* is closed.

According to this construction, the compression coil spring 34 remains stable in the hinge holder 33 when the platen cover 10*a* is closed. Therefore, even if the platen cover 10*a* is opened and closed frequently, it is possible to prevent the earlier mentioned chronic problem that the hinge holder breaks after an extended period of use due to violent vibrations of the compression coil spring, thereby achieving improved durability of the hinge mechanism.

This is further explained in detail in the following. The hinge torque produced by the compression coil spring 34 biasing the platen cover 10*a* in its opening direction varies in a nonlinear (curved) form with the opening angle of the platen cover 10*a* as shown in FIG. 5, for example. Specifically, the load torque of the platen cover 10*a* produced by its own weight (shown by a broken line in FIG. 5) increases as the opening angle of the platen cover 10*a* decreases. While the platen cover 10*a* falls by its own weight at and below an angle of a point of free fall where the curved line representing the load torque intersects a solid line representing the hinge torque (FIG. 5), the compression coil spring 34 produces the hinge torque during the free fall of the platen cover 10*a*. In addition, even after the platen cover 10*a* has fallen completely, the compression coil spring 34 continues to exert some hinge torque, although its amount is not so large.

When the platen cover 10*a* is closed, a generally upward directed perpendicular P to a tangent line (not shown) passing a point of contact between the cam 35 and the roller 36 is offset (obliquely directed) from the rotary shaft (pivot axis) 38 of the cam 35 toward the front of the platen cover 10*a* as shown in FIG. 4, for example. This means that the direction of the perpendicular P is offset toward the center of curvature of the cam 35 marked by "X" in FIG. 4. In other words, the perpendicular P is offset by as much as a distance d from the rotary shaft (pivot axis) 38 of the cam 35 as illustrated. Accordingly, the hinge mechanism produces a small amount of hinge torque which is equal to the product of a component of a force exerted in the direction of the perpendicular P tending to rotate the platen cover 10*a* in its opening angle, multiplied by the distance d which is the length of the arm through which the force acts, when the platen cover 10*a* is closed as shown in FIG. 4.

In this condition, the compression coil spring 34 is kept in a stable compressed state within the hinge holder 33, so that it produces no vibrations when the platen cover 10*a* is closed. Therefore, unlike the hinge mechanism of the prior art, the compression coil spring 34 of this invention does not cause such a problem as breakage of an internal wall of the hinge holder 33. It is also possible to prevent displacement of the original 61 due to lifting of the platen cover 10*a* as well as entry of stray light into the optical scanning system 22. Furthermore, the aforementioned construction of the invention ensures high durability of the hinge mechanism.

In addition, because the hinge torque generated by the compression coil spring 34 is smoothly transmitted to the platen cover 10*a* through the roller 36 and the cam 35 when the platen cover 10*a* is opened and closed, the platen cover 10*a* can be smoothly opened and closed even if the automatic document feeder 10 assembled with the platen cover 10*a* is heavy.

The cam 35 is so shaped as to hold the platen cover 10*a* stationary at a particular open position. Specifically, there is formed a recess 35*a* in a rolling surface (cam surface) of the cam 35 so that the cam 35 can hold the platen cover 10*a* at its specific opening angle where the roller 36 fits in the recess 35*a*. This arrangement makes it possible to properly set the original 61 in position on the platen glass 21 and verify the position of the original 61 with ease and certainty, thereby providing improved operability.

While the platen cover 10*a* is assembled with the automatic document feeder 10 to form a single structure in the present embodiment, the invention is not limited to this construction but the platen cover 10*a* may be supported alone swingably on top of the housing 20. Also, the copying machine provided with the platen cover 10*a* fixed by the hinge mechanism of the invention need not necessarily be constructed as illustrated in FIGS. 1 to 3. The invention is applicable to any image forming apparatus, regardless of its type or construction, as long as the apparatus is equipped with a platen cover that can be swung up and down to uncover and cover the top of the platen glass on which the original is placed.

It is apparent from the foregoing discussion that the present invention provides the following advantageous effects:

(1) Since the hinge unit produces a small amount of hinge torque biasing the platen cover in its opening direction even when the platen cover is closed, the elastic member remains in a stable state in the hinge holder. Therefore, unlike the conventional hinge mechanism, the hinge mechanism of the invention does not cause such a problem as breakage of the hinge holder due to violent vibrations of the elastic member which used to occur when closing the platen cover. This serves to improve the durability of the hinge mechanism.

(2) When the platen cover is opened and closed, the hinge torque produced by the elastic member is smoothly transmitted to the platen cover via the roller and the cam to ensure smooth opening and closing action of the platen cover.

(3) As the platen cover can be held stationary at a specific opening angle, the hinge mechanism of the invention makes it possible to properly set the original in position on the platen glass and verify the position of the original with ease and certainty, thereby providing improved operability.

(4) The generally upward directed perpendicular to the tangent line passing the point of contact between the roller and the cam is offset from the pivot axis of the cam when the platen cover is closed, so that a small amount of hinge torque directed generally upward is exerted on the platen cover even when it is closed. This also serves to maintain the elastic member in a stable state in the hinge holder.

(5) Since the generally upward directed perpendicular to the tangent line passing the point of contact between the roller and the cam is offset from the pivot axis of the cam toward the front of the platen cover when the platen cover is closed, the hinge torque is exerted on the closed platen cover. This serves to keep the elastic member in a stable compressed state within the hinge holder.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hinge mechanism supporting a platen cover for holding an original document at a fixed position on a platen glass of an image forming apparatus, said hinge mechanism comprising:

a hinge unit supporting the platen cover in such a manner that the platen cover is pivotable between an open position and a closed position, the hinge unit including an elastic member biasing the platen cover in its opening direction; and a hinge holder accommodating said hinge unit including said elastic member, said hinge holder being fitted in a hole formed in a rear end portion of a housing of the apparatus, wherein the hinge unit is accommodated in the portion of said hinge holder that is fitted in the hole, the platen cover is integrated with an automatic document feeder for feeding original documents to the platen glass automatically, said hinge unit is provided with a hinge torque keeping mechanism which causes said elastic member to produce a specific amount of hinge torque to bias the platen cover in its opening direction even when the platen cover is closed, said hinge unit includes a cam mounted on a shaft for pivotably supporting the platen cover, and a cover portion for covering said elastic member, the cover portion being slidably mounted in the hinge holder, wherein the cover portion has a point contact portion for point contact with said cam, and a center of a circular arc of a point of the cam in contact with the point contact portion is off from a line that passes the point contact portion and is parallel to a direction whereby the cover portion is slid, within a range of a diameter of the shaft perpendicular to the line.

2. The hinge mechanism according to claim 1, wherein said hinge torque keeping mechanism includes a cam for ensuring smooth opening and closing action of the platen cover and a roller which rolls over said cam.

3. The hinge mechanism according to claim 2, wherein said cam is so shaped as to hold the platen cover stationary at a particular open position.

4. The hinge mechanism according to claim 2, wherein said cam is shaped such that a generally upward directed perpendicular to a tangent line passing a point of contact between said cam and said roller is offset from a pivot axis of said cam when the platen cover is closed.

5. The hinge mechanism according to claim 4, wherein the generally upward directed perpendicular to the tangent line passing the point of contact between said cam and said roller is offset from the pivot axis of said cam toward the front of the platen cover.

* * * * *